United States Patent [19]

Havel

[11] Patent Number: 4,686,425

[45] Date of Patent: Aug. 11, 1987

[54] MULTICOLOR DISPLAY DEVICE

[76] Inventor: Karel Havel, P.O. Box 66, Station M, Toronto, Ontario, Canada, M6S 4T2

[21] Appl. No.: 892,837

[22] Filed: Aug. 4, 1986

Related U.S. Application Data

[63] Continuation-in-part of Ser. No. 856,196, Apr. 28, 1986.

[51] Int. Cl.[4] ..... H05B 37/02

[52] U.S. Cl. ..... 315/152; 250/205; 250/209; 250/552; 315/154; 315/158

[58] Field of Search ..... 250/205, 209, 552, 553; 315/152, 153, 154, 155, 156, 157, 158, 130, 131, 133, 134; 357/19

[56] References Cited

U.S. PATENT DOCUMENTS

| | | | |
|---|---|---|---|
| 3,210,549 | 10/1965 | Van Santen et al. | 250/205 |
| 3,696,389 | 10/1972 | Fenner | 250/553 |
| 3,875,456 | 4/1975 | Kano et al. | 313/501 |
| 3,911,423 | 10/1975 | Arndt et al. | 315/153 |
| 4,300,211 | 11/1981 | Hudson | 250/205 |
| 4,329,625 | 5/1982 | Nishizawa et al. | 315/158 |
| 4,484,105 | 11/1984 | Kriete et al. | 315/133 |

*Primary Examiner*—Harold Dixon

[57] ABSTRACT

A multicolor display device having seven illuminated optically stable states includes three triads of associated electro-optical components. In each triad, a light sensor is electrically coupled with a display light emitting diode and auxiliary light emitting diode. An optical feedback is established in each triad between the auxiliary light emitting diode and the light sensor tending to maintain its associated display light emitting diode either in the illuminated or extinguished condition. Light signals of respectively different colors emitted by three display light emitting diodes are blended to obtain a composite light signal of a color in accordance with the conditions of respective display light emitting diodes.

2 Claims, 4 Drawing Figures

MULTICOLOR DISPLAY DEVICE

CROSS-REFERENCE TO RELATED APPLICATIONS

This is a continuation-in-part of my copending application Ser. No. 06/856,196 filed April 28, 1986 entitled Multicolor Optical Device.

BACKGROUND OF THE INVENTION

1. Field of the Invention

This invention generally relates to display devices for emitting light of several different colors and more specifically to a display device having several stable states characterized by respectively different colors.

2. Description of the Prior Art

A multicolor semiconductor lamp comprising a plurality of light emitting diodes for emitting light of respectively different colors is disclosed in U.S. Pat. No. 3,875,456 issued on Apr. 1, 1975 to Tsuyoshi Kano et al. The light emitting diodes are closely adjacent and covered by a layer of light scattering material to provide an appearance of a single light source.

A circuit for selectively illuminating one of a pair of parallel back-to-back coupled light emitting diodes is disclosed in U.S. Pat. No. 4,484,105 issued on Nov. 20, 1984 to Richard J. Kriete et al. Two photon-emitting devices and two photon-responsive devices are additionally provided for selectively reversing current flow through the back-to-back coupled light emitting diodes to illuminate them either in red or green color. Since the two light emitting diodes are coupled to conduct current in opposite directions, they cannot be illuminated simultaneously to blend their emissions.

A display device capable of exhibiting more than two stable states characterized by respectively different colors is unknown.

SUMMARY OF THE INVENTION

Accordingly, it is the principal object of this invention to provide an improved multicolor display device exhibiting more than two stable optical states.

The invention resides in physical arrangement and electrical and optical coupling of three electro-optical triads, each including a light sensor, display light emitting diode, and auxiliary light emitting diode. As will be more fully pointed out subsequently, the display and auxliary light emitting diodes in each triad may be electrically coupled either in series or in parallel.

The auxiliary light emitting diode in each triad serves to maintain its associated display light emitting diode either fully illuminated or completely extinguished. Since light signals emitted by the auxiliary light emitting diodes are not viewed externally, their color may be selected at will.

Light signals of respectively different primary colors emitted by the display light emitting diodes are combined to obtain a composite light signal, which may be viewed externally, of a color in accordance with the conditions of respective display light emitting diodes.

Further objects of the invention will become obvious from the accompanying drawings and their description.

BRIEF DESCRIPTION OF THE DRAWINGS

In the drawings in which are shown several possible embodiments of the invention.

Throughout the drawings, like characters indicate like parts.

DESCRIPTION OF THE PREFERRED EMBODIMENTS

Figure 1:
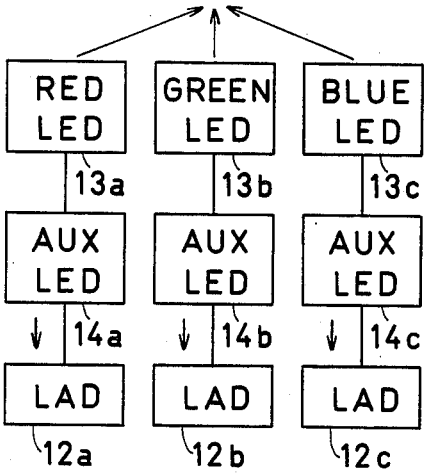
FIG. 1 is a generalized block diagram illustrating the inventive principles.

Referring now, more particularly, to the drawings, in FIG. 1 is shown, in very general configuration, a multicolor display device of the present invention which comprises three triads of electrically coupled electro-optical components. The first triad includes a display red LED (light emitting diode) 13*a*, auxiliary LED 14*a*, and LAD (light activated device) 12*a*. The second triad includes a display green LED 13*b*, auxiliary LED 14*b*, and LAD 12*b*. The third triad includes a display blue LED 13*c*, auxiliary LED 14*c*, and LAD 12*c*. The light activated devices, or light sensors, typically exhibit resistance variable in accordance with illumination. An optical feedback is established in each triad from the auxiliary LED to its associated LAD to exert a toggle effect by varying its resistance in a sense tending to maintain its associated display LED either in the illuminated or extinguished condition. The light signals emitted by the three display LEDs are blended to form a composite light signal of a color in accordance with the conditions of respective display LEDs. Consequently, the device has eight possible states: emitting light of red color, green color, blue color, yellow color, purple color, blue-green color, white color, or being extinguished. As will be more specifically revealed subsequently, all these states are optically and electrically stable.

The terms 'light source', 'light activated device', and 'light sensor' as used throughout the description of the invention are intended to be interpreted in a broad sense. Light sources may include light emitting diodes, liquid crystal devices, plasma devices, and the like. Light sensors may include phototransistors, photodiodes, photodarlingtons, phototriacs, photo sensitive silicon controlled rectifiers, photodetectors, photoresistors, photoconductive cells, and the like. Optical feedback between the auxiliary LED and light sensor in each triad may be established either by suitable physical arrangement therebetween or, alternatively, by use of light channeling devices which may include mirrors, prismatic devices, lenses, optical fibers, reflectors, directors, filters, and the like.

Figure 2:
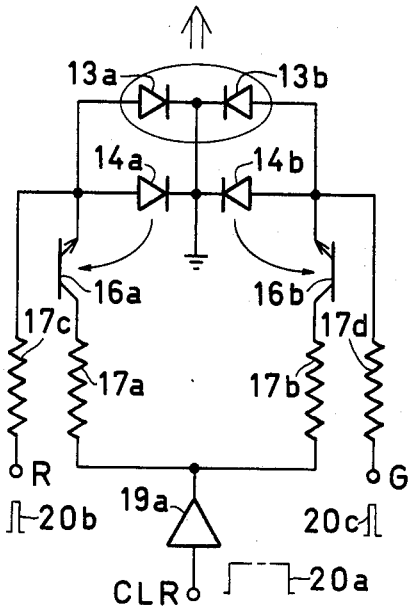
FIG. 2 is a schematic diagram of a two-primary color display device.

A display device incorporating the features of the present invention is illustrated in a schematic diagram form in FIG. 2. Two voltage levels, referred to as a logic high and low, respectively, are used throughout the description of the circuit. The device employs commercially well known phototransistors which exhibit very high resistance, typically hundreds of Megaohms, when maintained in dark and very low resistance, typically tens of Ohms, when illuminated.

To extinguish the device, a low logic level is momentarily applied to its Clear input CLR. As a consequence, the output of a preferably TTL (Transistor Transistor Logic) buffer 19*a* also drops to a low logic level. Since a TTL device is not capable of sourcing current from a low logic level output, no current can flow therefrom to ground. All LEDs 13*a*, 13*b*, 14*a*, and 14*b* therefore extinguish, and resistances of the phototransistors 16*a*, and 16*b* rise to very high values. When a high logic level 20*a* returns to the input CLR, the output of the buffer 19*a* also rises to a high logic level. However, the currents flowing via resistor 17*a*, high resistance of phototransistor 16*a* and LEDs 13*a*, 14*a* in parallel to ground, and via resistor 17*b*, high resistance of phototransistor 16*b* and LEDs 13*b*, 14*b* in parallel to ground, are very small and not sufficient to illuminate the LEDs. This state is therefore stable and will exist until either of or both inputs R, G are activated.

To illuminate the device in red color, a relatively narrow positive going pulse 20*b* is applied to its input R (Red). The width of the pulse depends on the response time of the phototransistor and should be sufficient to allow its resistance to drop below a predetermined triggering point. As a consequence, current flows from the input R, via current limiting resistor 17*c*, which confines the current flow, and LEDs 13*a*, 14*a* in parallel to ground. The auxiliary LED 14*a* illuminates, and its emission causes the resistance of its associated phototransistor 16*a* to rapidly drop to a very low value. As a result of positive optical feedback, whereby the increase in luminance of the auxiliary LED causes the decrease in resistance of the phototransistor which in turn has an effect of further increase in the luminance and further decrease in the resistance, the current in the display red LED branch, from buffer 19*a*, via resistor 17*a* and phototransistor 16*a*, sharply rises to a value sufficient to maintain the LEDs 13*a*, 14*a* fully illuminated. At the conclusion of the pulse 20*b*, the magnitude of the LED current is limited substantially by the value of the current limiting resistor 17*a*. It is readily apparent that this state is stable and will exist until another input of the device is activated.

To illuminate the device in green color, a positive going pulse 20*c* is applied to its input G (Green). As a consequence, current flows from the input G, via current limiting resistor 17*d* and LEDs 13*b*, 14*b* in parallel to ground. The auxiliary LED 14*b* illuminates, and its emission causes the resistance of its associated phototransistor 16*b* to drop to a very low value. The current in the display green LED branch, from buffer 19*a*, via resistor 17*b* and phototransistor 16*b*, sharply rises to a value sufficient to maintain the LEDs 13*b*, 14*b* illuminated.

To illuminate the device in yellow color, both pulses 20*b*, and 20*c* are applied, either simultaneously or sequentially, to respective inputs R and G. As a consequence, currents flow from the input R, via current limiting resistor 17*c* and LEDs 13*a*, 14*a* in parallel to ground and from the input G, via current limiting resistor 17*d* and LEDs 13*b*, 14*b* in parallel to ground. Both auxiliary LEDs 14*a*, and 14*b* illuminate, and their emissions respectively cause the resistances of associated phototransistors 16*a*, and 16*b* to drop to very low values. The currents in the display red LED and display green LED branches sharply rise to values sufficient to maintain all LEDs 13*a*, 13*b*, 14*a*, and 14*b* illuminated. The red and green light signals emitted by the display LEDs 13*a*, and 13*b* are blended to form a composite light signal of substantially yellow color. The hue of the composite light signal may be accurately adjusted by varying the values of current limiting resistors 17*a*, and 17*b*.

Figure 3:
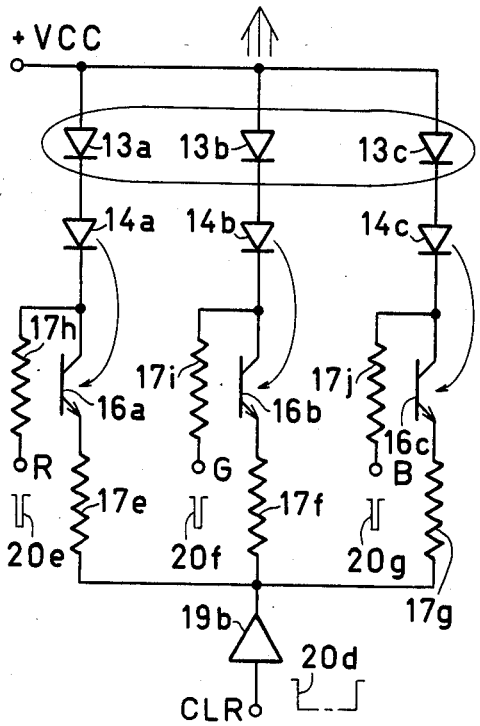
FIG. 3 is a schematic diagram of a three-primary color display device.

Since the display device shown in FIG. 3 is similar to the one shown in FIG. 2, it will be described only briefly. The light emitting diodes 13*a*, 13*b*, 13*c*, 14*a*, 14*b*, and 14*c* are reversed with respect to like LEDs in FIG. 2, and a positive voltage +VCC (typically+5 V) is applied to the interconnected anodes of the display LEDs. Logic levels of the control pulses are also reversed. The device may be extinguished by applying a high logic level to its Clear input CLR; a low logic level therein will maintain its instant condition. To illuminate the device in blue color, a negative going pulse 20*g* is applied to its input B (Blue). As a consequence, current flows from the source +VCC, via display LED 13*c*, auxiliary LED 14*c*, coupled in series, and current limiting resistor 17*j* to input terminal B. The auxiliary LED 14*c* illuminates, and its emission causes the resistance of its associated phototransistor 16*c* to drop to a very low value. The current in the display blue LED branch sharply rises to a value sufficient to maintain the LED 13*c* illuminated, being limited only by the value of current limiting resistor 17*g*.

To illuminate the device in purple color, both pulses 20*e*, and 20*g* are applied, either simultaneously or sequentially, to respective inputs R and B. As a consequence, currents flow from the source +VCC, via display LED 13*a*, auxiliary LED 14*a* and resistor 17*h* to input terminal R and from the source +VCC, via display LED 13*c*, auxiliary LED 14*c*, and resistor 17*j* to input terminal B. Both auxiliary LEDs 14*a*, and 14*c* illuminate, and their emissions respectively cause the resistances of associated phototransistors 16*a*, and 16*c* to drop to very low values. The currents in the display red LED and display blue LED branches sharply rise to values sufficient to maintain all LEDs 13*a*, 13*c*, 14*a*, and 14*c* illuminated. The red and blue light signals emitted by the display LEDs 13*a*, and 13*c* are blended to form a composite light signal of substantially purple color.

To illuminate the device in blue-green color, both pulses 20*f*, and 20*g* are applied, either simultaneously or sequentially, to respective inputs G and B. As a consequence, currents flow from the source +VCC, via display LED 13*b*, auxiliary LED 14*b*, and resistor 17*i* to input terminal G and from the source +VCC, via display LED 13*c*, auxiliary LED 14*c*, and resistor 17*j* to input terminal B. Both auxiliary LEDs 14*b*, and 14*c* illuminate, and their emissions respectively cause the resistances of associated phototransistors 16*b*, and 16*c* to drop to very low values. The currents in the display green LED and display blue LED branches sharply rise to values sufficient to maintain all LEDs 13*b*, 13*c*, 14*b*, and 14*c* illuminated. The green and blue light signals emitted by the display LEDs 13*b*, and 13*c* are blended to form a composite light signal of substantially blue-green color.

To illuminate the device in white color, all three pulses 20*e*, 20*f*, and 20*g* are applied, either simultaneously or sequentially, to respective inputs R, G, and B. As a consequence, currents flow from the source +VCC, via display LED 13*a*, auxiliary LED 14*a*, and resistor 17*h* to terminal R, from the source +VCC, via display LED 13*b*, auxiliary LED 14*b*, and resistor 17*i* to terminal G, and from the source +VCC, via display LED 13*c*, auxiliary LED 14*c*, and resistor 17*j* to terminal B. The three auxiliary LEDs 14*a*, 14*b*, and 14*c* illuminate, and their emissions respectively cause the resistances of associated phototransistors 16*a*, 16*b*, and 16*c* to drop to very low values. The currents in the display red LED, display green LED, and display blue LED branches sharply rise to values sufficient to maintain all LEDs 13*a*, 13*b*, 13*c*, 14*a*, 14*b*, and 14*c* illuminated. The red, green, and blue light signals emitted by the display LEDs 13*a*, 13*b*, and 13*c* are blended to form a composite light signal of substantially white color.

An important consideration has been given to physical arrangement of the light sources and sensors in the display device of the invention, to simultaneously provide the blending of primary colors and optically separated feedbacks in respective triads.

Figure 4:
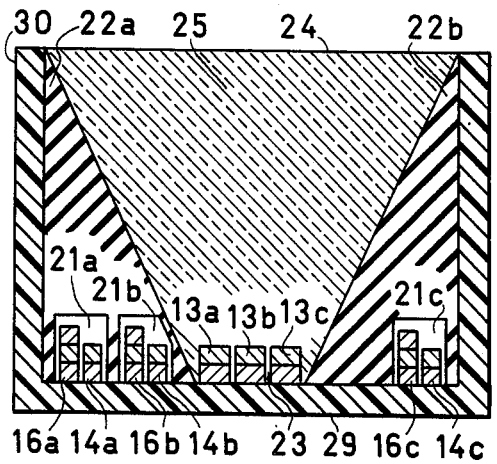
FIG. 4 is a cross-sectional view revealing internal structure of a multicolor display device shown in FIG. 3.

Referring additionally to FIG. 4, which should be considered together with FIG. 3, the display device is comprised of a housing 30 having two opaque walls 22*a* and 22*b* secured to a base 24 and tapered in the thickness toward the top of the housing. The inner inclined surfaces of the walls define therebetween a light blending cavity 23. The dimensions of the housing should be considered as merely illustrative and may be modified. The display light emitting diodes 13*a*, 13*b*, and 13*c*, adapted for emitting upon activation light signals of red, green, and blue primary colors, respectively, are mounted within the light blending cavity on a base portion 29. The three display LEDs are completely surrounded by light scattering material 25 serving to disperse the light signals to form a composite light signal of a composite color that emerges at the top surface 24 of the light blending cavity. Three chambers 21*a*, 21*b*, and 21*c*, which are secured from the presence of ambient light and optically isolated from one another, are formed in the opaque walls 22*a*, and 22*b* for accommodating respective pairs of auxiliary LED and phototransistor 14*a* and 16*a*, 14*b* and 16*b*, 14*c* and 16*c*. In each pair, the active area of the phototransistor is oriented to intercept light signals emitted by the associated auxiliary LED to exert a toggle effect by varying resistance of the phototransistor in a sense tending to maintain its associated display LED either in the illuminated or extinguished condition.

All matter herein described and illustrated in the accompanying drawings should be interpreted as illustrative and not in a limiting sense. It would be obvious that numerous modifications can be made in the construction of the preferred embodiments shown herein, without departing from the spirit of the invention as defined in the appended claims.

CORRELATION TABLE

This is a correlation table of reference characters used in the drawings herein, their descriptions, and examples of commercially available parts.

| # | DESCRIPTION | EXAMPLE |
|---|---|---|
| 12 | light activated device | |
| 13a | red display LED | |
| 13b | green display LED | |
| 13c | blue display LED | |
| 14 | auxiliary LED | |
| 16 | phototransistor | MRD310 |
| 17 | resistor | |
| 19 | buffer | 74LS244 |
| 20 | pulse | |
| 21 | chamber | |
| 22 | opaque wall | |
| 23 | light blending cavity | |
| 24 | top surface of light blending cavity | |
| 25 | light scattering material | |
| 29 | base portion | |
| 30 | housing | |

What I claim is:

1. A multicolor display device comprising:

three display light emitting diodes for emitting upon activation light signals of respectively different primary colors, each said display light emitting diode being capable either of an illuminated or extinguished condition;

means for blending said light signals to obtain a composite light signal of a color in accordance with the condition of respective display light emitting diodes;

three auxiliary light emitting diodes respectively electrically coupled to said display light emitting diodes, thereby forming three pairs of associated display light emitting diode and auxiliary light emitting diode;

three light sensors respectively electrically serially coupled to said pairs of associated display light emitting diode and auxiliary light emitting diode, each said light sensor having resistance variable with illumination; and three chambers secured from the presence of ambient light for respectively accommodating the pairs of serially coupled light sensor and auxiliary light emitting diode, in each said pair the active area of said light sensor being oriented to intercept light signals emitted by its serially coupled auxiliary light emitting diode to exert a toggle effect by varying the resistance of said light sensor in a sense tending to maintain its serially coupled display light emitting diode either in the illuminated or extinguished condition.

2. A multicolor display device comprising:

a housing having a base and two opaque walls secured to said base, said walls being tapered in the thickness toward the top of said housing and having inner inclined surfaces defining a light blending cavity therebetween;

three display light emitting diodes disposed in said light blending cavity for emitting upon activation light signals of respectively different primary colors, each said display light emitting diode being capable either of an illuminated or extinguished condition;

means for blending within said light blending cavity said light signals to obtain a composite light signal of a color in accordance with the conditions of respective display light emitting diodes;

three auxiliary light emitting diodes respectively electrically coupled to said display light emitting diodes, thereby forming three pairs of associated display light emitting diode and auxiliary light emitting diode;

three light sensors respectively electrically serially coupled to said pairs of associated display light emitting diode and auxiliary light emitting diode, each said light sensor having resistance variable with illumination; and three chambers disposed in said opaque walls and secured from the presence of ambient light for respectively accommodating the pairs of serially coupled light sensor and auxiliary light emitting diode, in each said pair the active area of said light sensor being oriented to intercept light signals emitted by its serially coupled auxiliary light emitting diode to exert a toggle effect by varying the resistance of said light sensor in a sense tending to maintain its serially coupled display light emitting diode either in the illuminated or extinguished condition.

* * * * *